US009121222B2

(12) United States Patent
Walker et al.

(10) Patent No.: US 9,121,222 B2
(45) Date of Patent: Sep. 1, 2015

(54) GATE BRACKET

(75) Inventors: Simon Walker, Tsawwassen (CA); Hou Jun (Frank) Fan, Surrey (CA); Wei Min (Karen) Zhu, Surrey (CA); Jianzhong Zhu, Suzhou (CN)

(73) Assignee: Peak Innovations Inc., Richmond (CA)

( * ) Notice: Subject to any disclaimer, the term of this patent is extended or adjusted under 35 U.S.C. 154(b) by 722 days.

(21) Appl. No.: 12/442,390

(22) PCT Filed: Sep. 20, 2007

(86) PCT No.: PCT/CA2007/001698

§ 371 (c)(1),
(2), (4) Date: Mar. 20, 2009

(87) PCT Pub. No.: WO2008/034260

PCT Pub. Date: Mar. 27, 2008

(65) Prior Publication Data

US 2009/0315009 A1 Dec. 24, 2009

(30) Foreign Application Priority Data

Sep. 20, 2006 (CA) ..... 2560419

(51) Int. Cl.

| | |
|---|---|
| ***E06B 3/964*** | (2006.01) |
| ***E06B 11/02*** | (2006.01) |
| ***E06B 3/968*** | (2006.01) |

(52) U.S. Cl.

CPC ..... *E06B 11/02* (2013.01); *E06B 3/9641* (2013.01); *E06B 3/9687* (2013.01); *Y10T 29/49826* (2015.01)

(58) Field of Classification Search

IPC .... E06B 11/02,3/9641, 3/9687; Y10T 29/49826
See application file for complete search history.

(56) References Cited

U.S. PATENT DOCUMENTS

| | | | | |
|---|---|---|---|---|
| 891,604 | A | 6/1908 | Diamond | |
| 1,758,955 | A | 5/1930 | Lovejoy | |
| 2,039,125 | A | 4/1936 | Stuart | |
| 3,472,543 | A * | 10/1969 | Biro | 403/295 |
| D222,903 | S | 2/1972 | Griffith | |
| D229,822 | S | 1/1974 | Born | |
| 4,024,691 | A | 5/1977 | Hansen | |
| D251,018 | S | 2/1979 | Lockwood | |
| 4,183,488 | A | 1/1980 | Shepard | |
| D259,083 | S | 5/1981 | Riegsecker | |
| 4,411,547 | A | 10/1983 | Johnson | |
| 4,592,672 | A | 6/1986 | Ruch | |
| D290,223 | S | 6/1987 | Westerheim | |
| D310,165 | S | 8/1990 | Cobb | |

(Continued)

FOREIGN PATENT DOCUMENTS

| | | |
|---|---|---|
| CA | 1051242 | 3/1979 |
| CA | 1075533 A1 | 4/1980 |

(Continued)

*Primary Examiner* — Gregory Strimbu
(74) *Attorney, Agent, or Firm* — Smiths IP

(57) ABSTRACT

A gate bracket is formed of a planar web in which two rectangular portions along two edges of the web are bent to define a first pair of perpendicular flanges, and two other rectangular portions are bent from an inner portion of the web to form a second pair of perpendicular flanges. The flanges of the first pair are spaced from the flanges of the second pair by a distance corresponding to the dimensions of the structural members used to construct the gate. The invention provides a rigid bracket of simpler and lighter construction than prior art brackets.

10 Claims, 5 Drawing Sheets

(56) References Cited

U.S. PATENT DOCUMENTS

| | | | | | |
|---|---|---|---|---|---|
| D313,933 | S | | 1/1991 | Petley | |
| D318,127 | S | | 7/1991 | Ebeler | |
| D324,784 | S | | 3/1992 | Rose | |
| D342,662 | S | | 12/1993 | Lavin | |
| 5,328,287 | A | | 7/1994 | Gilb | |
| 5,399,044 | A | | 3/1995 | Gilb | |
| D358,983 | S | | 6/1995 | Friend et al. | |
| D362,383 | S | | 9/1995 | Boelling | |
| D364,331 | S | | 11/1995 | Leek | |
| 5,579,595 | A | * | 12/1996 | Dutton | 38/102.1 |
| 5,690,305 | A | | 11/1997 | Perkins | |
| D410,835 | S | * | 6/1999 | Cosgrove | D8/354 |
| D425,467 | S | | 5/2000 | Runfola | |
| 6,694,700 | B1 | | 2/2004 | Mackett | |
| 7,178,305 | B2 | * | 2/2007 | Petrova | 52/715 |
| 7,316,098 | B1 | * | 1/2008 | Sackett | 52/92.2 |

FOREIGN PATENT DOCUMENTS

| | | |
|---|---|---|
| CA | 81567 | 8/1997 |
| CA | 83049 | 2/1998 |
| CA | 83050 | 2/1998 |
| CA | 85510 | 1/1999 |
| CA | 2306197 A1 | 10/2001 |
| CA | 2406698 C | 2/2005 |

* cited by examiner

GATE BRACKET

FIELD OF THE INVENTION

This invention relates to a set of brackets for constructing a wooden gate.

BACKGROUND OF THE INVENTION

Corner gate brackets can be used to frame right angle joints between structural members of a gate at each of four corners. Such gate brackets are meant to provide a reliable guide for the positioning of the structural members to assist the do-it-yourself handy man. In addition, corner gate brackets are meant to minimize or eliminate the distortion of the gate structure over time.

Gate brackets are typically made of metal so as to resist bending and to ensure a rigid structure. Typically, a gate bracket comprises elongate flat metal members arranged in perpendicular relationship so as to guide the formation of a right angle between the pieces of structural lumber which are made to abut the elongate members. An example of such a system is disclosed in Boroviak, U.S. Pat. No. 6,896,244.

Parallel elongate flat metal members may be provided in a spaced relationship for bracketing structural lumber on two opposed sides and to provide a perpendicular arrangement of such elongate members. Such a system is disclosed in Cosgrove, U.S. Design Pat. No. D410,835. In Cosgrove, each pair of parallel elongate flat metal members form a U-shape and the two U-shaped pairs are welded together to form the overall bracket.

To provide structural rigidity for gate brackets, typically either a brace member is provided, as in Boroviak, or relatively thick metal members are provided, as in Cosgrove. In Boroviak, the diagonal brace member is welded to each of the perpendicular elongate metal members, which are in turn welded together at the intersection.

It is an object of the present invention to provide a structural gate bracket that serves to effectively frame a right angle between structural pieces, such as 2×4 pieces of lumber, while maintaining the structural relationship of the joint, over time, and at the same time not providing undue weight to the gate bracket, avoiding overly thick metal elements or excessive welding.

This and other objects of the invention will be better understood with reference to the detailed description of the invention which follows.

SUMMARY OF THE INVENTION

According to the invention, there is provided a web extending in a plane. A first pair of perpendicular elongate portions are provided normal to the plane of the web, preferably along two edges of the web. A second pair of perpendicular elongate portions are provided normal to the plane of the web in spaced parallel relationship to the first pair.

In another aspect of the invention, each pair of elongate portions comprises flanges of said web.

In a further aspect, an opening is provided in said web member between the first and second pairs of elongate portions.

In a further aspect, the opening extends between a first pair of parallel first and second members and between a second pair of parallel first and second members thereby defining a substantially L-shaped opening.

In another aspect, the invention comprises a web extending in perpendicular directions in a plane, said web including a first flange extending normal to said plane parallel to a first one of said directions, a second flange extending normal to said plane parallel to a second one of said directions in an end-to-end perpendicular, abutting relationship to said first flange. The web has an outer perimeter, an opening extending in generally perpendicular directions within said perimeter, a third flange normal to said plane along an edge of said opening and in spaced relationship to said first flange and a fourth flange normal to said plane along an edge of said opening and in spaced relationship to said second flange.

In another aspect, the invention comprises a method of forming a gate bracket comprising:

- providing a web extending generally in perpendicular directions within a plane and having an opening within the perimeter thereof, said opening extending generally in said perpendicular directions;
- bending one edge of said web to provide a first flange normal to said plane;
- bending a second edge of said web to provide a second flange normal to said plane and abutting said first flange in a perpendicular relationship;
- bending a portion of said web that is adjacent to an edge of said opening to form a third flange normal to said plane;
- bending a portion of said web that is adjacent to an edge of said opening to provide a fourth flange normal to said plane and in perpendicular abutting relationship to said third flange.

The foregoing was intended as a broad summary only and of only some of the aspects of the invention. It was not intended to define the limits or requirements of the invention. Other aspects of the invention will be appreciated by reference to the detailed description of the invention and to the claims.

BRIEF DESCRIPTION OF THE DRAWINGS

The invention will be described by reference to the detailed description of the invention and to the drawings thereof in which.

DETAILED DESCRIPTION OF THE INVENTION

Throughout the following description specific details are set out to provide a more thorough understanding of the invention. However, the invention may be practiced without these particulars. In other instances, well known elements have not been shown or described in detail to avoid unnecessarily obscuring the present invention. Accordingly, the description and drawings are to be regarded in an illustrative, rather than a restrictive, sense.

Figure 1:
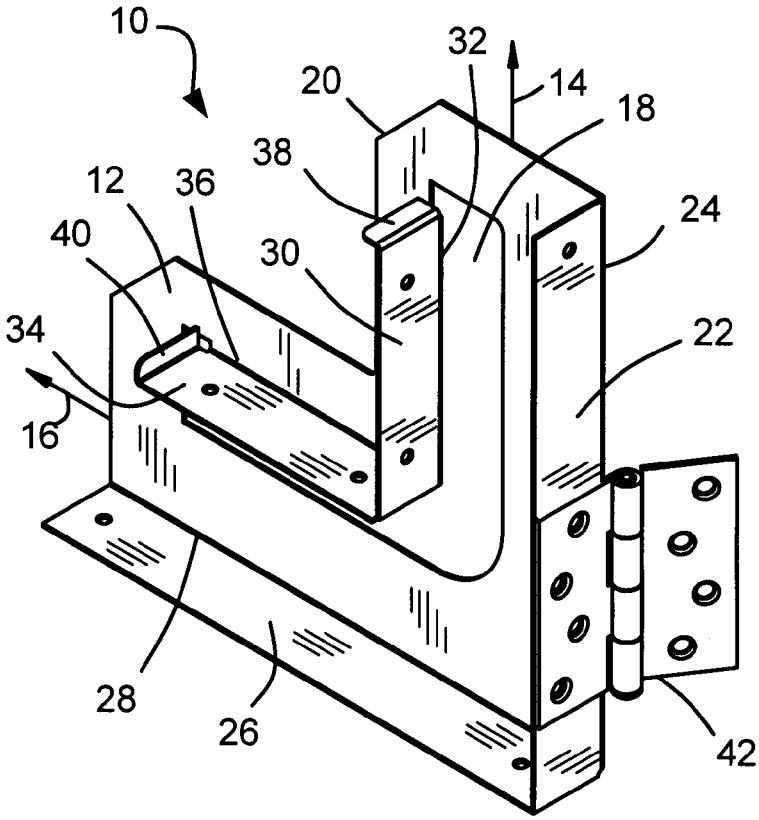
FIG. 1 is a front perspective view of a first embodiment of the invention.
Figure 2:
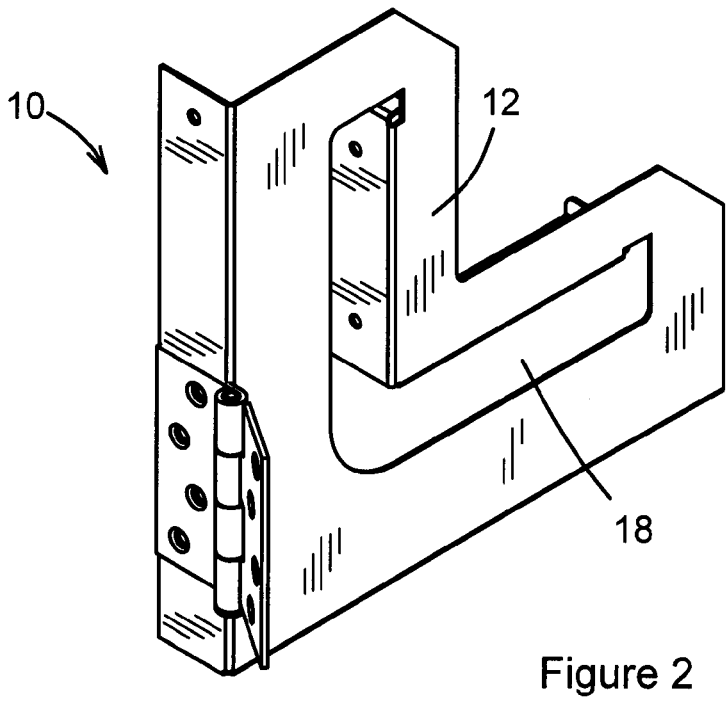
FIG. 2 is a rear perspective view of the first embodiment of the invention.
Figure 3:
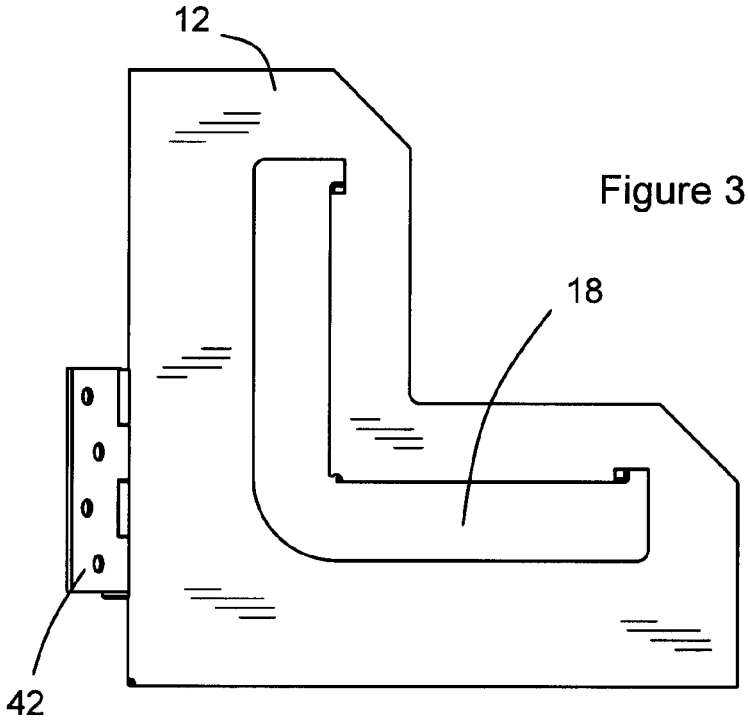
FIG. 3 is a plan view of the first embodiment.

Referring to FIGS. 1, 2 and 3 the gate bracket of the first embodiment 10 includes a web 12 extending within a plane generally along two perpendicular directions 14 and 16 in a generally L-shaped configuration.

Web 12 has a generally L-shaped opening 18 that extends in perpendicular directions parallel to directions 14 and 16. Opening 18 is spaced inwardly from the perimeter 20 of the web 12.

A first flange 22 extends normal to the plane of the web 12 along a perimetral edge 24 of web 12, parallel to direction 14. A second flange 26 extends normal to the plane of the web 12 along a perimetral edge 28 of web 12, parallel to direction 16. First 22 and second 26 flanges are in abutting perpendicular relationship to one another.

A third flange 30 extends normal to the plane of the web 12 along an edge 32 of opening 18. Third flange 30 extends parallel to first flange 22 and in spaced relationship therewith.

A fourth flange 34 extends normal to the plane of the web 12 along an edge 36 of opening 18. Third 30 and fourth 34 flanges are in abutting perpendicular relationship to one another.

The spacing between first 22 and third 30 flanges is selected so as to correspond to the dimensions of structural pieces (such as lumber, plastic or metal), to be used in the gate system, as is the spacing between second 26 and fourth 34 flanges.

One end of each of the third and fourth flanges may optionally be further bent away from opening 18 as at 38, 40 in order to provide additional structure rigidity to the flanges.

A hinge 42 may be provided on selected brackets according to whether the bracket will be used on the hinge side of the gate to be constructed.

One advantage of the first embodiment of the invention is that the entire structure, save for the attachment of a hinge, may be formed from a single flat sheet of materials, as will be described by reference to FIGS. 4 and 5.

Figure 4:
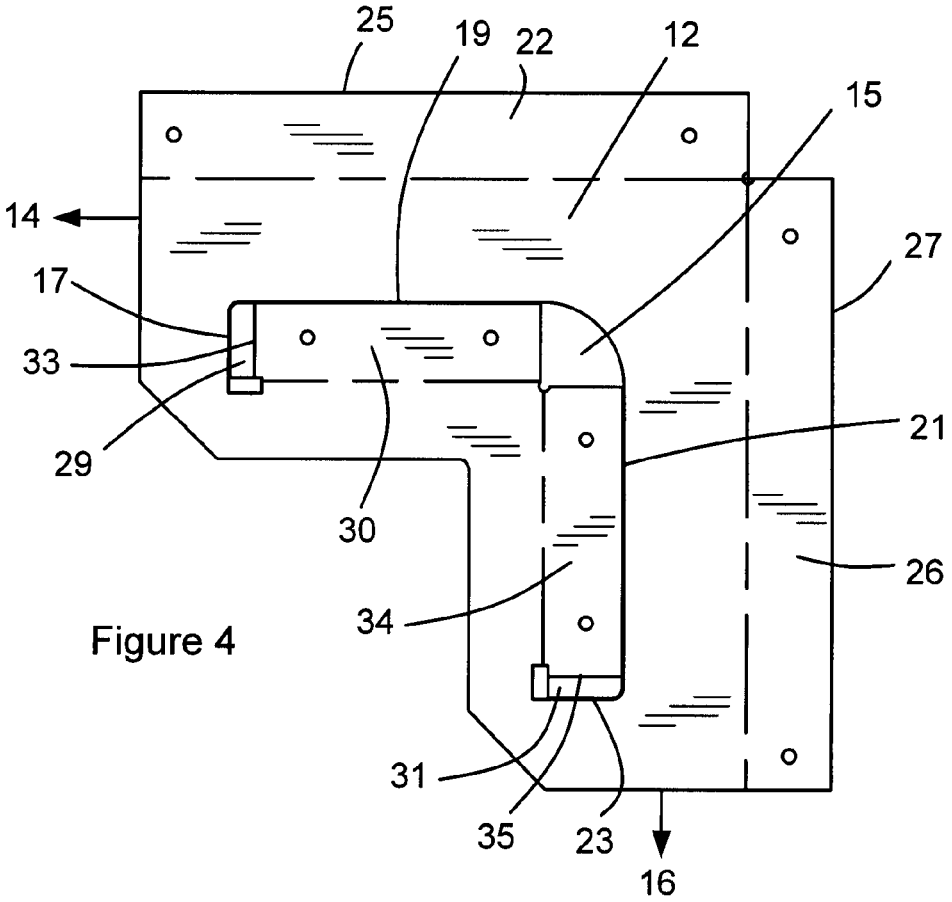
FIG. 4 is a plan view of a web member, prior to bending, according to the method of the first embodiment.
Figure 5:
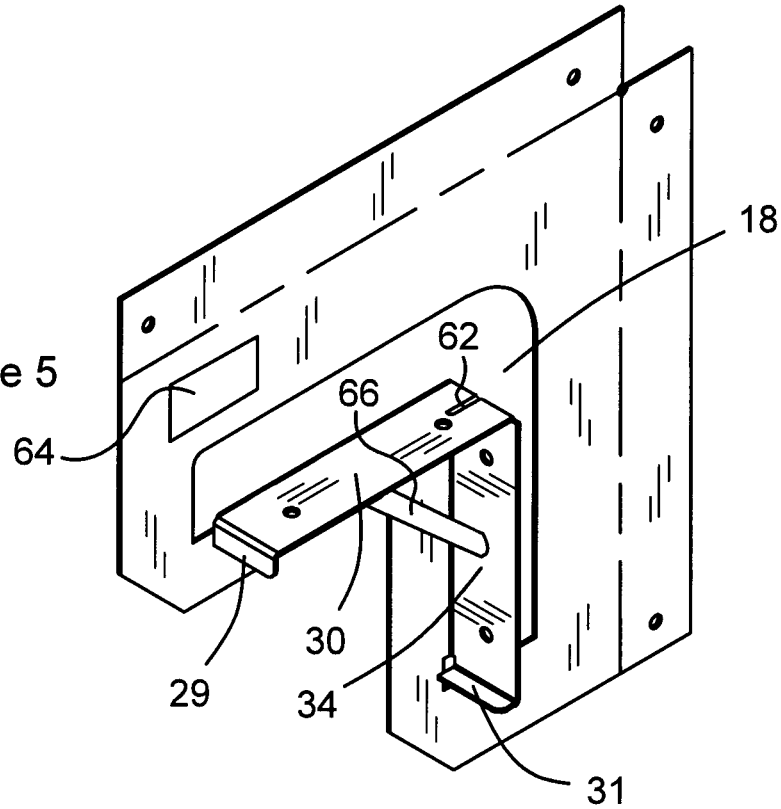
FIG. 5 is a front perspective view of a web member of FIG. 4 after the bending of the first and second flanges according to the method of the first embodiment.

There is first provided a web 12 as shown in FIG. 4 that extends generally in two perpendicular directions 14 and 16. Web 12 is cut at 17, 19, 21 and 23, with cut 19 being parallel to direction 14 and cut 21 being parallel to direction 16. Each cut 17, 19, 21, 23 is spaced inwardly from the edges of web 12. A gap 15 is provided at the juncture cut lines 19 and 21.

An elongated rectangular portion 30 is bent from the plane of the web so as to be normal to it and an elongated rectangular portion 34 is bent from the plane of the web so as to be normal to it to form flanges 30 and 34.

Short end portions 29, 31 of flanges 30, 34 may then be bent along lines 33, 35 so as to be normal to flanges 30, 34 to provide structural rigidity to flanges 30, 34.

An elongated rectangular portion 22 along edge 25 of web 12 is bent so as to form a flange 22 that is normal to the plane of the web 12. An elongated rectangular portion 26 along edge 27 of web 12 is bent so as to form a flange 26 that is normal to the plane of the web 12. Once bent, flanges 22 and 26 are in abutting perpendicular relationship and flanges 30, 34 are in abutting perpendicular relationship, as seen in FIGS. 1 and 2.

Figure 6:
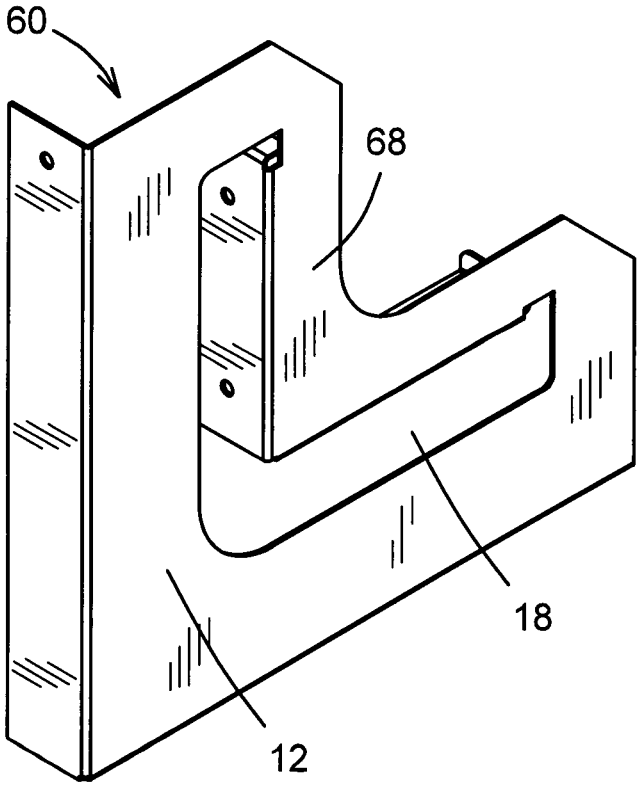
FIG. 6 is a rear perspective view of a second embodiment of the invention.

As shown in a second embodiment 60 illustrated in FIG. 6, the shape of the web 12 may be altered in area 68, for example to increase rigidity, and the hinge 42 may not be provided on selected brackets.

Figure 7:
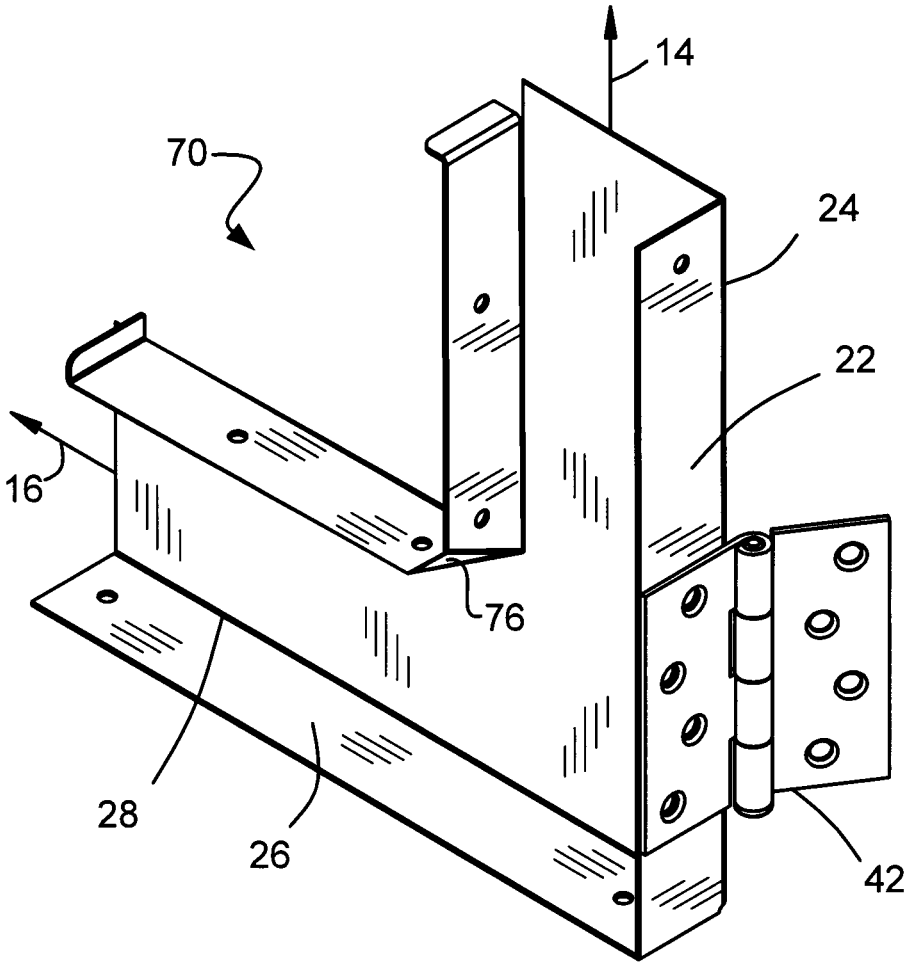
FIG. 7 is a front perspective view of a third embodiment of the invention.

As shown in the third embodiment 70 shown in FIG. 7, alternate embodiments of the invention do not require web 12 to extend into area 68 beyond flanges 30 and 40. Optional piece 76 could be welded between flanges 30 and 40 to assist with the structural integrity of the bracket.

Figure 8:
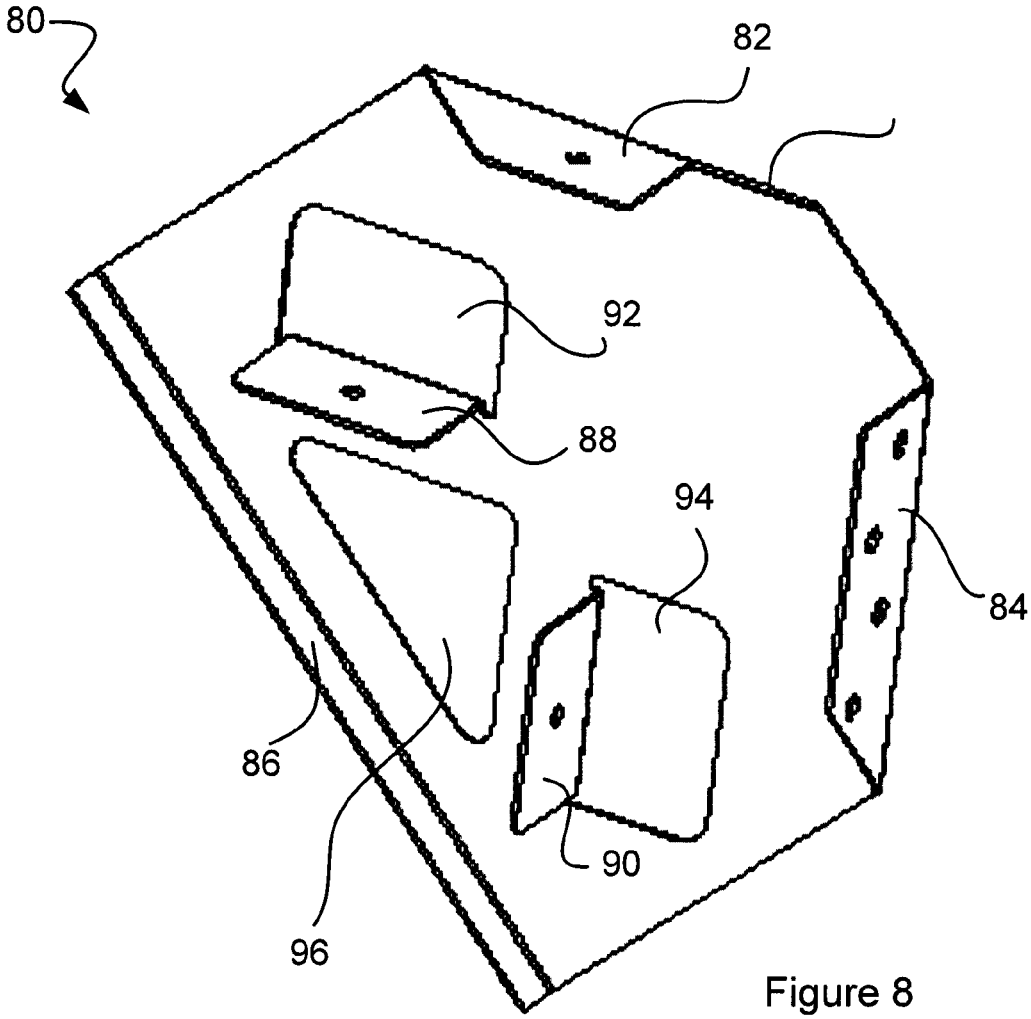
FIG. 8 is a front perspective view of a fourth embodiment of the invention.
Figure 9:
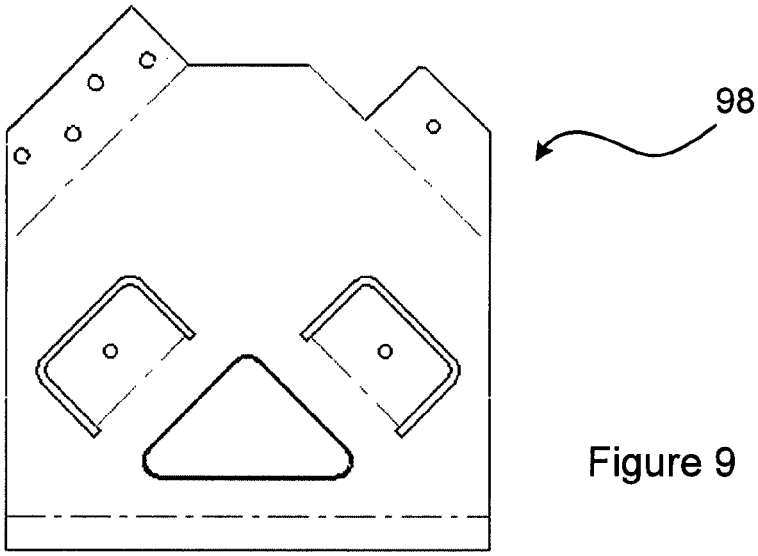
FIG. 9 is a plan view of the fourth embodiment of the invention, prior to bending.

A fourth embodiment 80 is shown in FIG. 8 in which a straight edge 86 can brace the portion between perpendicular structural members on a corner. Flanges 82 and 84 can be attached to the outside edges of structural members while flanges 88 and 90 can be attached to the inside edges. Flange 82 together with flange 88 and flange 84 together with flange 90 can firmly hold the structural members (such as 2×4 lumber pieces) of the corner of a gate in place. When folded in position, flanges 88 and 90 leave openings 92 and 94 in embodiment 80. The edge along 86 can be reinforced by folding the edge over itself, as shown in FIGS. 8 and 9. Further, a hole 96 may be provided, for example to reduce the overall material used and the weight of the embodiment. For versions of embodiment 80 used on the side of the gate to which a hinge should be attached, a hinge may be attached to one of flanges 82 and 84, and preferably to flange 84. As shown in FIG. 9 with reference to planar layout 98, embodiment 80 can be made from a flat piece of unitary material, such as sheet metal.

In a method of assembly of a gate or door, four brackets as described above, may be used in the construction of a gate. Two brackets placed on adjacent corners may have hinges, whereas the two other brackets may not have hinges. Structural pieces, such as lumber, plastic or metal members may be used in the assembly of the gate. Typically four structural pieces of lumber (or equivalent) will be used to create a gate frame in a square or rectangular formation. Gate face structural members, such as 2×4 pieces of lumber, can then be secured to the gate frame to complete the gate. As understood in the art, the face structural members could be attached to one side of the gate frame, on both sides, or having face structural members in an alternating pattern with structural members secured to opposing sides of the gate frame.

Many other variations or additional features can be practiced in accordance with this invention. For example, a structural brace 66 could be added between flanges 30 and 34. The structural brace would help maintain the structural integrity of the corner of the gate. The structural brace could be placed at any suitable angle, such as 45 degrees from each of flanges 30 and 34.

Portions 64 of web 12 could be punched out, cut out, or otherwise removed from the structure without departing from the scope of the invention. Cutting out portions 64 of web 12 could be of any desired shape and location and would reduce the amount of material, such as metal, and reduce the weight of the gate bracket.

In certain embodiments, reinforcing lines 62 could be used to add structural integrity to the metal. Reinforcing lines 62 could be depressions formed on one side of the metal, with a corresponding protrusion on the opposite side of the metal. To maximize effectiveness of the reinforcing lines 62, the lines may be linear. Reinforcing lines 62 could be added to web 12 or flanges 30 and 31.

It will be appreciated by those skilled in the art that the first and second embodiments have been described above in some detail but that certain modifications may be practiced without departing from the principles of the invention.

What is claimed is:

1. A bracket for framing a gate made of structural members, the bracket comprising a continuous web extending in a plane;

a first pair of perpendicular elongate portions extending normal to said plane;

a second pair of perpendicular elongate portions cut from said web and extending normal to said plane in a spaced parallel relationship to said first pair of elongated portions to form two channels extending perpendicular to one another for receiving said structural members of said gate;

an opening in said web, wherein said opening defines two longitudinal axes extending in directions generally perpendicular to one another in said the plane, a perimeter of said opening is defined in part by said second pair of the perpendicular elongate portions, and wherein said web extends a distance beyond said perimeter; and wherein said web and said first and second pairs of perpendicular elongate portions are formed from a unitary sheet of material.

2. The bracket of claim 1 wherein each of said elongate portions comprises a bent flange.

3. The bracket of claim 2, wherein said opening extends between the first and second pairs of elongate portions.

4. The bracket of claim 3 wherein said web generally extends in said directions that are generally perpendicular to one another.

5. The bracket of claim 4 wherein said first pair of elongate portions abut and extend generally perpendicular to one another.

6. The bracket of claim 5 wherein said second pair of elongate portions abut and extend generally perpendicular to one another.

7. The bracket of claim 1 wherein said web generally extends in said directions that are generally perpendicular to one another, and said opening extends between said first and second pairs of perpendicular elongate portions.

8. The bracket of claim 7 wherein said first pair of elongate portions abut and extend generally perpendicular to one another and said second pair of elongate portions abut and extend generally perpendicular to one another.

9. The bracket of claim 1 wherein each of said second pair of perpendicular elongate portions comprises a bent end.

10. The bracket of claim 1 further comprising a hinge secured to one of said first pair of elongate portions.

* * * * *